US006252509B1

(12) United States Patent
Hester

(10) Patent No.: US 6,252,509 B1
(45) Date of Patent: Jun. 26, 2001

(54) REMOTE-CONTROLLED AUDIO-VISUAL ALARM SYSTEM FOR NORMALLY INVISIBLY MOUNTING IN CORNER SOFFITS OF A HOUSE

(75) Inventor: Yvette Hester, 23 Stanley St., Inwood, NY (US) 11096

(73) Assignee: Yvette Hester, NY (US)

( * ) Notice: Subject to any disclaimer, the term of this patent is extended or adjusted under 35 U.S.C. 154(b) by 0 days.

(21) Appl. No.: 09/559,336

(22) Filed: Apr. 27, 2000

(51) Int. Cl.[7] ..... G08B 23/00

(52) U.S. Cl. ..... 340/573.1; 340/539; 340/691.1; 340/693.9

(58) Field of Search ..... 340/573.1, 539, 340/691.1, 693.5, 693.9; 379/37, 38

(56) References Cited

U.S. PATENT DOCUMENTS

| | | | | |
|---|---|---|---|---|
| 3,911,425 | * | 10/1975 | Muncheryan | 340/326 |
| 4,003,040 | * | 1/1977 | Browand | 340/332 |
| 4,547,761 | * | 10/1985 | Jones | 340/331 |
| 4,730,184 | * | 3/1988 | Bach | 340/691.1 |
| 4,855,723 | * | 8/1989 | Fritz et al. | 340/691.1 |
| 4,878,236 | * | 10/1989 | Ray et al. | 379/37 |
| 4,931,780 | * | 6/1990 | LaMont et al. | 340/691.1 |
| 4,993,058 | * | 2/1991 | McMinn et al. | 379/37 |
| 5,265,616 | * | 11/1993 | Hoshino | 600/301 |
| 5,270,698 | * | 12/1993 | Hoyle et al. | 340/815.01 |
| 5,587,704 | * | 12/1996 | Foster | 340/573.1 |
| 5,880,672 | * | 3/1999 | Weaver | 340/332 |

* cited by examiner

*Primary Examiner*—Thomas Mullin

(57) ABSTRACT

A remote-controlled audio-visual alarm system for normally invisibly mounting in corner soffits of a house and being in the corner soffits of the house so as to be highly visible and not obstructed when activated. The system includes at least one transmitter, at least one receiver, and at least one alarm. The alarm includes a stationary portion for invisibly mounting in any corner soffit of the house, and a movable portion that is movably mounted in the stationary portion thereof. The stationary portion includes a housing sleeve for invisibly mounting in the corner soffit of the house. The movable portion includes a neck sleeve that is movably mounted in the housing sleeve and retracts and extends therefrom, and is completely hidden therein when fully retracted so as to be normally invisible, but when any transmitter is activated, automatically extends out of the housing sleeve, and a head that is movably mounted to the neck sleeve, by a ball and socket, so as to allow the head to swivel into any preset position and face a desired direction depending upon which corner soffit of the house the alarm is mounted in when the neck sleeve is extended. The head contains visual and audible devices which are automatically activated when the movable portion is extended out of the stationary portion, which occurs automatically when any transmitter is activated.

13 Claims, 1 Drawing Sheet

REMOTE-CONTROLLED AUDIO-VISUAL ALARM SYSTEM FOR NORMALLY INVISIBLY MOUNTING IN CORNER SOFFITS OF A HOUSE

BACKGROUND OF THE INVENTION

1. Field of the Invention

The present invention relates to a remote-controlled audio-visual alarm system. More particularly, the present invention relates to a remote-controlled audio-visual alarm system for normally invisibly mounting in corner soffits of a house.

2. Description of the Prior Art

Alarm systems are useful for summoning assistance in emergency situations, particularly where, for whatever reason, one cannot phone for help.

In the past, there have been many diverse types of emergency warning devices for the home. These have included smoke detectors, burglar alarms, and other such devices designed to alert those in and/or outside the home of the existence of an emergency requiring prompt attention.

It has often been the case, particularly with those living in rural areas, that firemen, policemen, and paramedics have considerable difficulty in locating the site of an emergency, and the lost time has often resulted in unnecessary damage to property and, most importantly, aggravation of serious medical conditions and even death.

Numerous innovations for emergency attention getting devices have been provided in the prior art that will be described. Even though these innovations may be suitable for the specific individual purposes to which they address, however, they differ from the present invention in that they do not teach a remote controlled audio-visual alarm system for invisibly mounting in soffits of a house.

For example, U.S. Pat. No. 3,911,425 to Muncheryan teaches an alarm system for signalling for emergency help during sudden illness or intrusion by burglars or other criminals. The system comprises an intermittently sounding alarm device with concurrently flashing red light means which signals by means of large letters the word "HELP." The system is operated remotely by manually turning on an emergency switch or by an automatic wireless switching device using a microwave transmitter-receiver arrangement. The invention is also provided with a timing mechanism which turns on the sound alarm with the flashing light at a predetermined time. The signalling unit is positioned facing toward the street whereby it is readily visible to neighbors and passerbys for providing the needed help.

Another example U.S. Pat. No. 4,003,040 to Browand teaches a flashing door sign that comprises a casing having illuminable house numbers at the front thereof. The casing contains red and white light bulbs which are selectively operable by a switch located inside of the house; the switch has positions corresponding to a continuous white light, flashing white light, and flashing red light to indicate an emergency. The switch must be moved in a non-rotational direction to enter the emergency position.

Still another example, U.S. Pat. No. 4,547,761 to Jones teaches a distress light and signal system including a light adapted to be anchored in the ground in proximity to a road passing by a house. The light includes a switch for selectively actuating the light in an emergency from within the house and is powered by a solar collector and a rechargeable battery. Information is retained at a location remote from the house including directions for use by a person responding to the emergency. The system includes immediate retrieval of the information upon notification of the existence of an emergency at the house. With these features, a person responding to an emergency may reach the house rapidly by visually locating the light upon reaching the vicinity of the house.

Yet another example, U.S. Pat. No. 4,855,723 to Fritz et al. teaches an alarm system that has an alarm unit that includes a siren, a stroboscopic light, and an address display. The alarm unit is located on a building so as to be visible from the building exterior. The address display is made up of one or more characters, arranged so as to make up the address of the building. The characters are formed by plural light emitting diodes. Switching circuitry activates the siren and the stroboscopic light, and switches the display to full brilliance. Reset circuitry deactivates the siren and the stroboscopic light, and returns the display to a preactivation level of brilliance. A portable transmitter unit can be used to activate the alarm system. Interlock circuitry prevents the deactivation of the stroboscopic light and the address display before the siren is deactivated. The alarm system can be operated in one of two modes. The first mode has the siren operate continuously, and the second mode has the siren operate intermittently.

Still yet another example, U.S. Pat. No. 5,270,698 to Hoyle et al. teaches a switching device for flashing an installed light fixture, as for helping emergency response personnel locate a dwelling. A switch housing which is mountable within a conventional junction box encloses a switch having "off", "on", and "flash" positions. In the "flash" position, the switch cyclically completes and interrupts the installed 120 volt AC circuit so that the light fixture flashes on and off. A triac is employed as a relay for completing the circuit, and a timer-controlled driver portion is provided for actuating the triac. The triac driver actuates the triac at the beginning of each half-cycle of the AC current, in response to a low-voltage pulse which passes through a capacitor connected to the high-voltage lead. The timer may be a 555 IC timer, and a conversion network may be provided for supplying DC current for this. A piezoelectric element is also provided for generating an audible signal indicating that the "flash" mode has been actuated. The duty cycle of the device can be adjusted as desired, to provide anything from long-term illumination of the bulb to a short flash.

It is apparent that numerous innovations for emergency attention getting devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a remote-controlled audio-visual alarm system for normally invisibly mounting in corner soffits of a house that avoids the disadvantages of the prior art.

Another object of the present invention is to provide a remote-controlled audio-visual alarm system for normally invisibly a mounting in corner soffits of a house that is simple and inexpensive to manufacture.

Still another object of the present invention is to provide a remote-controlled audio-visual alarm system for normally invisibly mounting in corner soffits of a house that is simple to use.

Briefly stated, yet another object of the present invention is to provide a remote-controlled audio-visual alarm system for normally invisibly mounting in corner soffits of a house and being in the corner soffits of the house so as to be highly visible and not obstructed when activated. The system includes at least one transmitter, at least one receiver, and at least one alarm. The alarm includes a stationary portion for invisibly mounting in any corner soffit of the house, and a movable portion that is movably mounted in the stationary portion thereof. The stationary portion includes a housing sleeve for invisibly mounting in the corner soffit of the house. The movable portion includes a neck sleeve that is movably mounted in the housing sleeve and retracts and extends therefrom, and is completely hidden therein when fully retracted so as to be normally invisible, but when any transmitter is activated, automatically extends out of the housing sleeve, and a head that is movably mounted to the neck sleeve, by a ball and socket, so as to allow the head to swivel into any preset position and face a desired direction depending upon which corner soffit of the house the alarm is mounted in when the neck sleeve is extended. The head contains visual and audible devices which are automatically activated when the movable portion is extended out of the stationary portion, which occurs automatically when any transmitter is activated.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
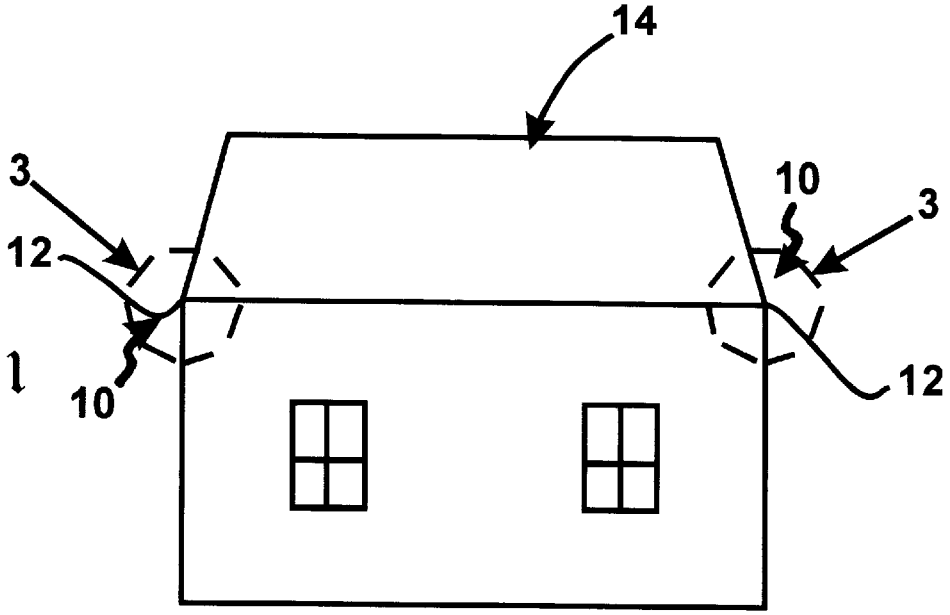
FIG. 1 is a diagrammatic perspective view of the present invention normally invisibly mounted in the corner soffits of a house.

10 remote-controlled audio-visual alarm system of present invention for normally invisibly mounting in corner soffits 12 of house 14

12 corner soffits of house 14

14 house

16 at least one transmitter 16 for positioning, and being accessible by user from, inside house 14

18 at least one receiver for positioning inside house 14

20 at least one alarm for normally invisibly mounting in corner soffit 12 of house 14

22 stationary portion of alarm 20 for invisibly mounting in any corner soffit 12 of house 14

24 movable portion of alarm 20

26 housing sleeve of stationary portion 22 of alarm 20 for invisibly mounting in corner soffit 12 of house 14

28 lowermost terminal edge of housing sleeve 26 of stationary portion 22 of alarm 20 for positioning flush with corner soffit 12 of house 14 flange of housing sleeve 26 of stationary portion 22 of alarm 20 for fastening housing sleeve 26 of stationary portion 22 of alarm 20 in corner soffit 12 of house 14

32 vertically-oriented longitudinal axis of housing sleeve 26 of stationary portion 22 of alarm 20

34 neck sleeve of movable portion 24 of alarm 20

36 lowermost terminal edge of neck sleeve 34 of movable portion 24 of alarm 20

37 head of movable portion 24 of alarm 20

38 ball and socket of movable portion 24 of alarm 20

40 visual and audible devices contained in head 37 of movable portion 24 of alarm 20

42 cable of movable portion 24 of alarm 20

DETAILED DESCRIPTION OF THE PREFERRED EMBODIMENT

Referring now to the figures, in which like numerals indicate like parts, and particularly to FIG. 1, which is a diagrammatic perspective view of the present invention normally invisibly it mounted in the corner soffits of a house, the remote-controlled audio-visual alarm system of the present invention is shown generally at 10 for normally invisibly mounting in corner soffits 12 of a house 14 and being in the corner soffits 12 of the house 14 so as to be highly visible and not obstructed when activated.

Figure 2:
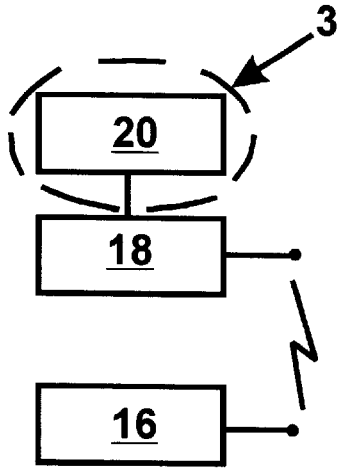
FIG. 2 is a block diagram of the present invention.

The overall configuration of the remote-controlled audio-visual alarm system 10 can best be seen in FIG. 2, which is a block diagram of the present invention, and as such, will be discussed with reference thereto.

The remote-controlled audio-visual alarm system 10 comprises at least one transmitter 16 for positioning, and being accessible by a user from, inside the house 14.

The remote-controlled audio-visual alarm system 10 further comprises at least one receiver 18 for positioning inside the house 14, and which is in communication with the at least one transmitter 16.

The remote-controlled audio-visual alarm system 10 further comprises at least one alarm 20 for normally invisibly mounting in the corner soffit 12 of the house 14, and which is in electrical communication with the at least one receiver 18 so as to allow the at least one alarm 20 to activate regardless of which of the at least one transmitter 16 is activated.

Figure 3:
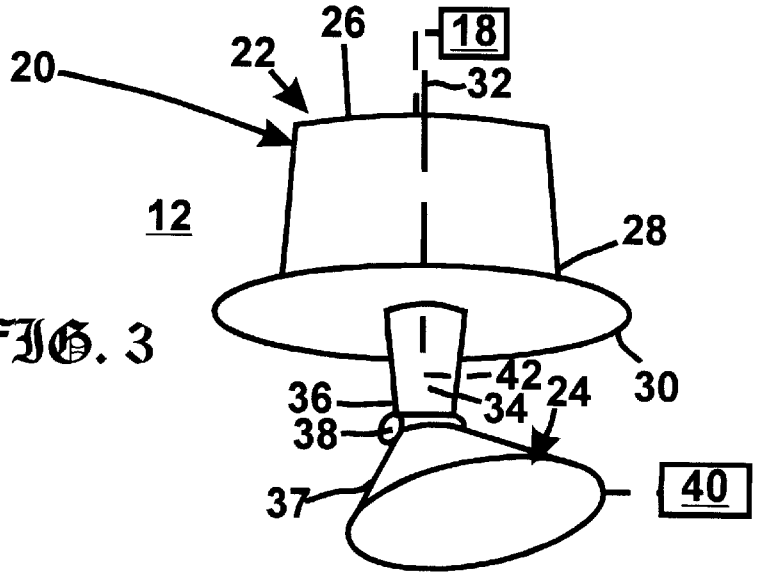
FIG. 3 is a diagrammatic perspective view of the area generally, enclosed by the dotted curves identified by ARROWS 3 in, FIGS. 1 and 2 of the alarm of the present invention.

The specific configuration of the alarm 20 can best be seen in FIG. 3, which is a diagrammatic perspective view of the area generally enclosed by the dotted curves identified by ARROWS 3 in FIGS. 1 and 2 of the alarm of the present invention, and as such, will be discussed with reference thereto.

The alarm 20 comprises a stationary portion 22 for invisibly mounting in any corner soffit 12 of the house 14 and a movable portion 24 that is movably mounted in the stationary portion 22 thereof.

The stationary portion 22 of the alarm 20 comprises a housing sleeve 26 for invisibly mounting in the corner soffit 12 of the house 14.

The housing sleeve 26 of the stationary portion 22 of the alarm 20 is vertically-oriented, cylindrically-shaped, and has a diameter and a lowermost terminal edge 28 for positioning flush with the corner soffit 12 of the house 14.

The housing sleeve 26 of the stationary portion 22 of the alarm 20 further has a flange 30 that is ring-shaped, horizontally-oriented, and extends completely around the lowermost terminal edge 28 thereof for fastening the housing sleeve 26 of the stationary portion 22 of the alarm 20 in the corner soffit 12 of the house 14, and a vertically-oriented longitudinal axis 32.

The movable portion 24 of the alarm 20 comprises a neck sleeve 34 that depends from, and is movably mounted in, the housing sleeve 26 of the stationary portion 22 of the alarm 20, and has a lowermost terminal edge 36.

The neck sleeve 34 of the movable portion 24 of the alarm 20 retracts and extends along the vertically-oriented longitudinal axis 32 of the housing sleeve 26 of the stationary portion 22 of the alarm 20, and is completely hidden in the housing sleeve 26 of the stationary portion 22 of the alarm 20 when fully retracted so as to be normally invisible, but when any transmitter 16 is activated, automatically extends out of the housing sleeve 26 of the stationary portion 22 of the alarm 20.

The movable portion 24 of the alarm 20 further comprises a head 37 that is movably mounted to, and extends and retracts with, the lowermost terminal edge 36 of the neck sleeve 34 of the movable portion 24 of the alarm 20, and is completely hidden in the housing sleeve 26 of the stationary portion 22 of the alarm 20 when the neck sleeve 34 of the movable portion 24 of the alarm 20 is fully retracted so as to be normally invisible.

The head 37 of the movable portion 24 of the alarm 20 is movably mounted to the lowermost terminal edge 36 of the neck sleeve 34 of the movable portion 24 of the alarm 20, by a ball and socket 38, so as to allow the head 37 of the movable portion 24 of the alarm 20 to swivel into any preset position and face a desired direction depending upon which corner soffit 12 of the house 14 the alarm 20 is mounted in when the neck sleeve 34 of the movable portion 24 of the alarm 20 is extended.

The head 37 of the movable portion 24 of the alarm 20 is conically-frustrum-shaped, has a diameter, and depends flaring for increasing propagation.

The diameter of the head 37 of the movable portion 24 of the alarm 20 is slightly less than the diameter of the housing sleeve 26 of the stationary portion 22 of the alarm 20 so as to allow the head 37 of the movable portion 24 of the alarm 20 to fully fit in the housing sleeve 26 of the stationary portion 22 of the alarm 20 when fully retracted, regardless of orientation of the head 37 of the movable portion 24 of the alarm 20, and thereby be normally invisible, and further seal the housing sleeve 26 of the stationary portion 22 of the alarm 20 against entrance of animals.

The head 37 of the movable portion 24 of the alarm 20 contains visual and audible devices 40 which are automatically activated when the movable portion 24 of the alarm 20 is extended out of the stationary portion 22 of the alarm 20, which occurs automatically when any transmitter 16 is activated.

The visual and audible devices 40 in the head 37 of the movable portion 24 of the alarm 20 are in electrical communication with the at least receiver 18, by a cable 42 that extends from the head 37 of the movable portion 24 of the alarm 20, through the neck sleeve 34 of the movable portion 24 of the alarm 20 so as to be shielded and thereby weatherproof.

It will be understood that each of the elements described above, or two or more together, may also find a useful application in other types of constructions differing from the types described above.

While the invention has been illustrated and described as embodied in a remote-controlled audio-visual alarm system for normally invisibly mounting in corner soffits of a house, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A remote-controlled audio-visual alarm system for normally invisibly mounting in corner soffits of a house and being in the corner soffits of the house so as to be highly visible and not obstructed when activated, said system comprising;

a) at least one transmitter for positioning, and being accessible by a user from, inside the house;

b) at least one receiver for positioning inside the house, and being in communication with said at least one transmitter; and c) at least one alarm for normally invisibly mounting in the corner soffit of the house, and being in electrical communication with said at least one receiver so as to allow said at least one alarm to activate regardless of which of said at least one transmitter is activated.

2. The system as defined in claim 1, wherein said alarm comprises:

a) a stationary portion for invisibly mounting in any corner soffit of the house; and b) a movable portion that is movably mounted in said stationary portion thereof.

3. The system as defined in claim 2, wherein said stationary portion of said alarm comprises a housing sleeve for invisibly mounting in the corner soffit of the house.

4. The system as defined in claim 3, wherein said housing sleeve of said stationary portion of said alarm is vertically-oriented, cylindrically-shaped, and has:

a) a diameter; and b) a lowermost terminal edge for positioning flush with the corner soffit of the house.

5. The system as defined in claim 4, wherein said housing sleeve of said stationary portion of said alarm further has:

a) a flange that is ring-shaped, horizontally-oriented, and extends completely around said lowermost terminal edge thereof for fastening said housing sleeve of said stationary portion of said alarm in the corner soffit of said house; and b) a vertically-oriented longitudinal axis.

6. The system as defined in claim 5, wherein said movable portion of said alarm comprises a neck sleeve that depends from, and is movably mounted in, said housing sleeve of said stationary portion of said alarm, and has a lowermost terminal edge.

7. The system as defined in claim 6, wherein said neck sleeve of said movable portion of said alarm retracts and extends along said vertically-oriented longitudinal axis of said housing sleeve of said stationary portion of said alarm, and is completely hidden in said housing sleeve of said stationary portion of said alarm when fully retracted so as to be normally invisible, but when any transmitter is activated, automatically extends out of said housing sleeve of said stationary portion of said alarm.

8. The system as defined in claim 7, wherein said movable portion of said alarm further comprises a head that is movably mounted to, and extends and retracts with, said lowermost terminal edge of said neck sleeve of said movable portion of said alarm, and is completely hidden in said housing sleeve of said stationary portion of said alarm when said neck sleeve of said movable portion of said alarm is fully retracted so as to be normally invisible.

9. The system as defined in claim 8, wherein said head of said movable portion of said alarm is movably mounted to said lowermost terminal edge of said neck sleeve of said movable portion of said alarm, by a ball and socket, so as to allow said head of said movable portion of said alarm to swivel into any preset position and face a desired direction depending upon which corner soffit of the house said alarm is mounted in when said neck sleeve of said movable portion of said alarm is extended.

10. The system as defined in claim 8, wherein said head of said movable portion of said alarm is conically-frustrum-shaped, has a diameter, and depends flaring for increasing propagation.

11. The system as defined in claim 10, wherein said diameter of said head of said movable portion of said alarm is slightly less than said diameter of said housing sleeve of said stationary portion of said alarm so as to allow said head of said movable portion of said alarm to fully fit in said housing sleeve of said stationary portion of said alarm when fully retracted, regardless of orientation of said head of said movable portion of said alarm, and thereby be normally invisible, and further seal said housing sleeve of said stationary portion of said alarm against entrance of animals.

12. The system as defined in claim 8, wherein said head of said movable portion of said alarm contains visual and audible devices which are automatically activated when said movable portion of said alarm is extended out of said stationary portion of said alarm, which occurs automatically when any transmitter is activated.

13. The system as defined in claim 12, wherein said visual and audible devices in said head of said movable portion of said alarm are in electrical communication with said at least receiver, by a cable that extends from said head of said movable portion of said alarm, and through said neck sleeve of said movable portion of said alarm so as to be shielded and thereby weatherproof.

* * * * *